US007653534B2

(12) United States Patent
Derboven et al.

(10) Patent No.: US 7,653,534 B2
(45) Date of Patent: Jan. 26, 2010

(54) APPARATUS AND METHOD FOR DETERMINING A TYPE OF CHORD UNDERLYING A TEST SIGNAL

(75) Inventors: Claas Derboven, Munich (DE); Sebastian Streich, Barcelona (ES); Markus Cremer, Berkeley, CA (US)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 348 days.

(21) Appl. No.: 11/607,659

(22) Filed: Dec. 1, 2006

(65) Prior Publication Data

US 2007/0144335 A1 Jun. 28, 2007

Related U.S. Application Data

(63) Continuation of application No. PCT/EP2005/004669, filed on Apr. 29, 2005.

(30) Foreign Application Priority Data

Jun. 14, 2004 (DE) ..... 10 2004 028 693

(51) Int. Cl.
*G10H 1/38* (2006.01)
*G10L 11/04* (2006.01)

(52) U.S. Cl. ..... 704/205; 704/270; 84/613; 84/637; 84/669

(58) Field of Classification Search ..... 704/236, 704/270, 278, 205; 84/613, 616, 637, 669
See application file for complete search history.

(56) References Cited

U.S. PATENT DOCUMENTS 4,142,433 A 3/1979 Gross ..... 84/1.03

(Continued)

FOREIGN PATENT DOCUMENTS

DE 3023578 C2 6/1980

(Continued)

OTHER PUBLICATIONS

Bartsch, M. et al. "To Catch a Chorus: Using Chroma-Based Representations for Audio Thumbnailing." IEEE Workshop on Applications of Signal Processing to Audio and Acoustics, pp. 15-18, 2001.

(Continued)

*Primary Examiner*—Martin Lerner
(74) *Attorney, Agent, or Firm*—Michael A. Glenn; Glenn Patent Group

(57) ABSTRACT

An apparatus for determining a type of chord has a means for providing a reference vector for the type of chord, a means for providing a reference vector from a test signal, and a means for comparing the reference vector with the test signal vector. The means for providing a reference vector is configured to provide, for the type of chord, a reference vector from a plurality of different reference vectors. In addition, the means for providing a test signal vector from the test signal is configured to provide the test signal vector having a plurality of test signal vector elements. In addition, the means for comparing the reference vector with the test signal vector is configured to compare the reference vector and the test vector or versions of the test signal vector which are cyclically shifted by different shift values, in order to obtain various comparison results which are allocated to the test signal vector or shift values, so as to determine the type of chord on the basis of an extreme comparison result and the shift value associated with same.

15 Claims, 5 Drawing Sheets

U.S. PATENT DOCUMENTS

| | | | | | |
|---|---|---|---|---|---|
| 4,184,401 | A | | 1/1980 | Hiyoshi et al. | 84/1.03 |
| 4,300,430 | A | * | 11/1981 | Bione et al. | 84/477 R |
| 4,354,418 | A | | 10/1982 | Moravec | |
| 4,412,473 | A | * | 11/1983 | Laflamme | 84/485 R |
| 4,467,689 | A | * | 8/1984 | Stier et al. | 84/715 |
| 4,694,280 | A | * | 9/1987 | Rollhaus et al. | 341/26 |
| 5,117,727 | A | | 6/1992 | Matsuda | |
| 5,442,129 | A | | 8/1995 | Mohrlok | |
| 5,459,281 | A | | 10/1995 | Shibukawa | 84/637 |
| 5,486,647 | A | * | 1/1996 | Kay et al. | 84/635 |
| 5,756,918 | A | | 5/1998 | Funaki | |
| 5,760,325 | A | | 6/1998 | Aoki | |
| 5,864,631 | A | * | 1/1999 | Shutoh | 382/113 |
| 6,057,502 | A | | 5/2000 | Fujishima | |
| 6,541,691 | B2 | * | 4/2003 | Tolonen et al. | 84/616 |
| 7,027,983 | B2 | * | 4/2006 | Puterbaugh et al. | 704/231 |
| 7,342,167 | B2 | * | 3/2008 | Cremer et al. | 84/611 |
| 7,346,500 | B2 | * | 3/2008 | Puterbaugh et al. | 704/205 |
| 7,353,167 | B2 | * | 4/2008 | Puterbaugh et al. | 704/207 |
| 7,460,994 | B2 | * | 12/2008 | Herre et al. | 704/231 |
| 7,580,832 | B2 | * | 8/2009 | Allamanche et al. | 704/205 |
| 2006/0075884 | A1 | * | 4/2006 | Streitenberger et al. | 84/616 |
| 2006/0075886 | A1 | * | 4/2006 | Cremer et al. | 84/635 |
| 2008/0115658 | A1 | * | 5/2008 | Fujishima et al. | 84/618 |
| 2009/0095145 | A1 | * | 4/2009 | Streich et al. | 84/609 |
| 2009/0100990 | A1 | * | 4/2009 | Cremer et al. | 84/623 |

FOREIGN PATENT DOCUMENTS

| | | |
|---|---|---|
| EP | 1278182 | 1/2003 |
| JP | 2003-263155 | 9/2003 |
| WO | WO01/04870 | 1/2001 |
| WO | WO01/88900 | 11/2001 |

OTHER PUBLICATIONS

Brown, J. "Calculation of a Constant Q Spectral Transform." J. Acoust. Soc. Am. 89(1), pp. 425-434, Jan. 1991.

Brown, J. et al. "An Efficient Algorithm for the Calculation of a Constant Q Transform," J. Acoust. Soc. Am. 92(5), pp. 2698-2701, Nov. 1992.

de la Cuadra, Patricio et al. "Efficient Pitch Detection Techniques for Interactive Music." Proceedings of the 2001 International Computer Music Conference, 2001.

Desainte-Catherine, M. et al. "High-Precision Fourier Analysis of Sounds Using Signal Derivatives," J. Audio Eng. Soc., 48(7), pp. 654-667, Jul./Aug. 2000.

Harris, F. "High-Resolution Spectral Analysis with Arbitrary Spectral Centers and Arbitrary Spectral Resolutions." Compt. & Elect. Engng., vol. 3, pp. 171-191, 1976.

Izmirli, O. et al. "Recognition of Musical Tonality from Sound Input." IEEE, pp. 269-271, 1994.

Lao, Weilun et al. "Computationally Inexpensive and Effective Scheme for Automatic Transcription of Polyphonic Music." IEEE International Conference on Multimedia and Expo, pp. 1775-1778, 2004.

Oppenheim, A. V. et al. "Computation of Spectra with Unequal Resolutions Using the Fast Fourier Transform," Proceedings of the IEEE, 59:299-301, Feb. 1971.

Raphael, C. "A Probabilistic Expert System for Automatic Musical Accompaniment," Journal of Computational and Graphical Statistic, 10(3) pp. 487-512, 2001.

Tzanetakis, G. et al. "Automatic Musical Genre Classification of Audio Signals," Proceedings of ISMIR, pp. 205-210, Oct. 2001.

Zhu, Y. et al. "Music Key Detection for Musical Audio." Proceedings of the 11$^{th}$ International Multimedia Modeling Conference, 2005.

Fujishima, Takuya, "Realtime Chord Recognition of Musical Sound: A System Using Common Lisp Music", *Proceedings of the 1999 International Computer Music Conference*, CCRMA, Stanford University, Stanford, CA 94305, Oct. 22-27, 1999, pp. 464-467, XP009053025.

* cited by examiner

FIGURE FOR ABSTRACT

FIGURE 2

| | H A | 7 | m7 | 9 |
|---|---|---|---|---|
| MAJOR | x | x | x | x |
| MINOR | x | x | x | x |
| sus4 | x | x | x | - |
| diminished | x | - | - | - |
| augmented | x | - | - | - |

400

| REFERENCE VECTOR | SCALAR PRODUCT | SHIFT VALUE | TYPE OF CHORD |
|---|---|---|---|
| MINOR | 0 | 0 | C MINOR |
| MINOR | 1 | 1 | C# MINOR |
| MINOR | 0 | 2 | D MINOR |
| ... | ... | ... | ... |
| MINOR | 1 | 5 | F MINOR |
| ... | ... | ... | ... |
| MINOR | 0 | 9 | A MINOR |
| MINOR | 3 | 10 | A# MINOR |
| MINOR | 0 | 11 | H MINOR |

FIGURE 4

APPARATUS AND METHOD FOR DETERMINING A TYPE OF CHORD UNDERLYING A TEST SIGNAL

CROSS-REFERENCE TO RELATED APPLICATION

This application is a continuation of copending International Application No. PCT/EP2005/004669, filed Apr. 29, 2005, designating the United States, and is not published in English, which claims priority of German Patent Application 10 2004 028 693.0-51, filed on Jun. 14, 2004, and is incorporated herein by reference in its entirety.

BACKGROUND OF THE INVENTION

1. Field of the Invention

The present invention relates to the technical field of musical harmony recognition, and in particular, the present invention relates to an apparatus and a method for determining a type of chord using a reference vector for a key of the type of chord.

2. Description of Prior Art

In the last ten years, due to the clearly improved storage and sound optimization of recorded pieces of music, the importance of classifying these pieces of music into styles of music has increased. However, it has had to be taken into account that in the last few years a multitude of subtypes of styles of music have formed, a classification into, for example, the styles of music of "classical music", "jazz", "rock music", . . . having proven to be no longer sufficient. In addition, one has had to bear in mind/to note that due to the considerable increase of pieces of music published, the formation of different tastes in music has also been boosted. The increase in the number of different tastes in music, and the marked increase of pieces of music published necessitated also a pre-classification of the pieces of music which is then enclosed, in an electronic form, as meta data (i.e. data about data) with the piece of music which was mostly also stored in an electronic form. Since the classification of the piece as may be taken from the meta data is often made obsolete due to the change in tastes of music, it was necessary to provide a possibility of generating meta data directly from the musical properties of a piece of music shortly before classification, wherein a classification of the piece of music then need not be stored in the meta data, but wherein only the musical and/or the music-theoretical properties of the piece of music are recognized from the piece of music itself, and wherein the style of music or subclass of the style of music of the piece of music may be inferred therefrom.

As an evident characterizing feature of a piece of music, the classification of occurring types of chords, such as a D major or a G minor chord in a piece of music, could serve as an important feature in classifying the piece of music to belong to a style of music or subclass of a style of music. In a first approach of recognizing a key of a piece of music, David Temperley suggested, in his document "The Recognition of Basic Musical Structures", The MIT Press, 2001, pages 173 to 187, to establish key profiles by means of an empirical psycho-acoustic reference model formation. These key profiles then indicate a frequency of how often a certain note occurs, for example in a piece of music in C major, in relation to other notes. Such key profiles are represented, for example, for the C major key in FIG. 5A and for the D minor key in FIG. 5B. If a piece of music to be examined is to be classified, the time durations of music of the individual halftones (for example C, C sharp, D, . . . ) occurring in this piece are evaluated using a histogram, and are correlated with the key profiles for the individual keys, a correlation coefficient being determined. Subsequently, the piece of music to be examined is classified to belong to that key which yields the highest correlation coefficient of the histogram resulting from the piece of music to be examined, and the respective key profile.

However, such an approach has the disadvantage that a temporally long segment of a piece of music is to be used for creating a meaningful histogram as a meaningful test signal vector), and that the key of the piece of music may change within this time segment of the piece of music to be examined. This will subsequently lead to an inaccurate classification of the piece of music. In addition, it is only the key of the piece of music (and/or of the examined time segment of the piece of music) that can be recognized by the above-described method; the recognition of the key of an individual chord is thus not ensured. This primarily results from the fact that, for short time segments, no meaningful histogram may be prepared due to the short time duration of the segment. Thus, the temporal resolution behavior of the above-described method is limited.

Thus, it is the object of the present invention to provide a possibility of determining a type of chord underlying a test signal, it being intended for the determination of the chord type underlying the test signal to provide a temporal resolution which is better than has been possible in the prior art.

SUMMARY OF THE INVENTION

In accordance with a first aspect, the invention provides an apparatus for determining a type of chord underlying a test signal, the type of chord being defined by an occurrence of predetermined frequencies in a frequency range of the test signal, and the predefined frequencies in the frequency range of the test signal corresponding to tones in a predetermined spectral margin, wherein a first type of chord has at least one predefined significant tone in the spectral margin and wherein a second type of chord has a second predefined significant tone in the spectral margin, wherein the first significant tone differs from the second significant tone, and wherein the apparatus for determining has:

a provider for providing a reference vector for the type of chord from a plurality of different reference vectors, the reference vector having a plurality of reference vector elements associated with one tone, respectively, in the spectral margin, and wherein at least one significant reference vector element is provided for each reference vector for a significant tone of an associated type of chord;

a provider for providing a test signal vector from the test signal, wherein the test signal vector has a plurality of test signal vector elements associated with one tone, respectively, in the spectral margin, wherein a test signal vector element is dependent on whether the tone associated with the test signal vector element occurs in the test signal, wherein the provider for providing a test signal vector is configured to allocate a value of one to a test signal vector element if the tone corresponding to the test signal vector element has an amplitude value which exceeds a predetermined threshold value, and wherein the provider for providing a test signal vector is configured to allocate a value of zero to the test signal vector element if the tone which corresponds to the test signal vector element has an amplitude value falling below the predetermined threshold value; and a comparator for comparing the reference vector with the test signal vector, the comparator being configured to compare the reference vector with the test signal vector or with versions of the test signal vector which are cyclically shifted by various shift values in the frequency range, in order to obtain various comparative results allocated to the test signal vector or shift values in order to determine the type of chord on the basis of an extreme comparative result and of the shift value associated with same.

In accordance with a second aspect, the invention provides a method for determining a type of chord underlying a test signal, the type of chord being defined by an occurrence of predetermined frequencies in a frequency range of the test signal, and the predefined frequencies in the frequency range of the test signal corresponding to tones in a predetermined spectral margin, wherein a first type of chord has at least one predefined significant tone in the spectral margin and wherein a second type of chord has a second predefined significant tone in the spectral margin, wherein the first significant tone differs from the second significant tone, and wherein the method for determining includes the steps of:

providing a reference vector for the type of chord from a plurality of different reference vectors, the reference vector having a plurality of reference vector elements associated with one tone, respectively, in the spectral margin, and wherein at least one significant reference vector element is provided for each reference vector for a significant tone of an associated type of chord;

providing a test signal vector from the test signal, wherein the test signal vector has a plurality of test signal vector elements associated with one tone, respectively, in the spectral margin, wherein a test signal vector element is dependent on whether the tone associated with the test signal vector element occurs in the test signal, wherein the step of providing a test signal vector includes allocating a value of one to a test signal vector element if the tone corresponding to the test signal vector element has an amplitude value which exceeds a predetermined threshold value, and wherein the step of providing a test signal vector includes allocating a value of zero to a test signal vector element if the tone which corresponds to the test signal vector element has an amplitude value falling below the predetermined threshold value; and comparing the reference vector with the test signal vector, the comparator being configured to compare the reference vector with the test signal vector or with versions of the test signal vector which are cyclically shifted by various shift values, in order to obtain various comparative results allocated to the test signal vector or shift values in order to determine the type of chord on the basis of an extreme comparative result and of the shift value associated with same.

In accordance with a third aspect, the invention provides a computer program having a program code for performing the method for determining a type of chord underlying a test signal, the type of chord being defined by an occurrence of predetermined frequencies in a frequency range of the test signal, and the predefined frequencies in the frequency range of the test signal corresponding to tones in a predetermined spectral margin, wherein a first type of chord has at least one predefined significant tone in the spectral margin and wherein a second type of chord has a second predefined significant tone in the spectral margin, wherein the first significant tone differs from the second significant tone, and wherein the method for determining includes the steps of:

providing a reference vector for the type of chord from a plurality of different reference vectors, the reference vector having a plurality of reference vector elements associated with one tone, respectively, in the spectral margin, and wherein at least one significant reference vector element is provided for each reference vector for a significant tone of an associated type of chord;

providing a test signal vector from the test signal, wherein the test signal vector has a plurality of test signal vector elements associated with one tone, respectively, in the spectral margin, wherein a test signal vector element is dependent on whether the tone associated with the test signal vector element occurs in the test signal, wherein the step of providing a test signal vector includes allocating a value of one to a test signal vector element if the tone corresponding to the test signal vector element has an amplitude value which exceeds a predetermined threshold value, and wherein the step of providing a test signal vector includes allocating a value of zero to a test signal vector element if the tone which corresponds to the test signal vector element has an amplitude value falling below the predetermined threshold value; and comparing the reference vector with the test signal vector, the comparator being configured to compare the reference vector with the test signal vector or with versions of the test signal vector which are cyclically shifted by various shift values, in order to obtain various comparative results allocated to the test signal vector or shift values in order to determine the type of chord on the basis of an extreme comparative result and of the shift value associated with same, when the program runs on a computer.

The present invention is based on the findings that by using a reference vector and a test signal vector determined from the test signal, a comparison of the reference signal vector with the test signal vector may be effected, and that the type of chord may be derived directly from the result of the comparison. Unlike the prior art, it is here no longer required to provide a large number of reference vectors. Rather, for a class of chord types such as the major chords, a reference value may be provided, and from the knowledge of a distance between two tones occurring in a chord, a fundamental tone of the type of chord to be determined may be ascertained by means of a cyclically shifting the test vector and comparing the shifted version of the test vector with the reference vector.

The inventive approach offers the advantage that a statistical distribution of the occurrence of tones, or halftones, (histogram) in the test signal is no longer required for determining the type of chord. Rather, the type of chord underlying the test signal may be determined in a simple manner by providing the reference vector and the test signal vector, derived from the test signal, with a subsequent simple cyclic shift of the elements of the test signal vector. Unlike the prior art, one does not need to fall back on a large number of reference vectors (which have been determined in a psychoacoustic manner). Also, compared to the prior art, the presence of a long-duration test signal is not required for determining the type of chord. This means that the test signal which has the type of chord underlying it may be clearly shorter than in conventional approaches. In particular, this results from the fact that, in the inventive approach, it is only the occurrence of a tone within the test signal that is detected in an element of the test signal vector, and that thus, for example, a simultaneous sounding of different tones within a short period of time (for example a quarter note) is sufficient to detect the type of chord underlying the test signal by means of the spectral distance of the tones. The inventive approach thus offers the advantage, over the prior art, of being able to examine clearly shorter time segments for types of chords, and thus of achieving a clearly higher level of granularity of the chord-type determination within a test signal.

BRIEF DESCRIPTION OF THE DRAWINGS

These and other objects and features of the present invention will become clear from the following description taken in conjunction with the accompanying drawing, in which:

FIG. 2 shows a table of reference vectors, for various classes of chord types, which may be provided in terms of music theory;

FIG. 4 shows a tabular representation of the association of a type of chord in accordance with the embodiment, shown in FIG. 3, of the inventive method.

DESCRIPTION OF PREFERRED EMBODIMENTS

Figure 1:
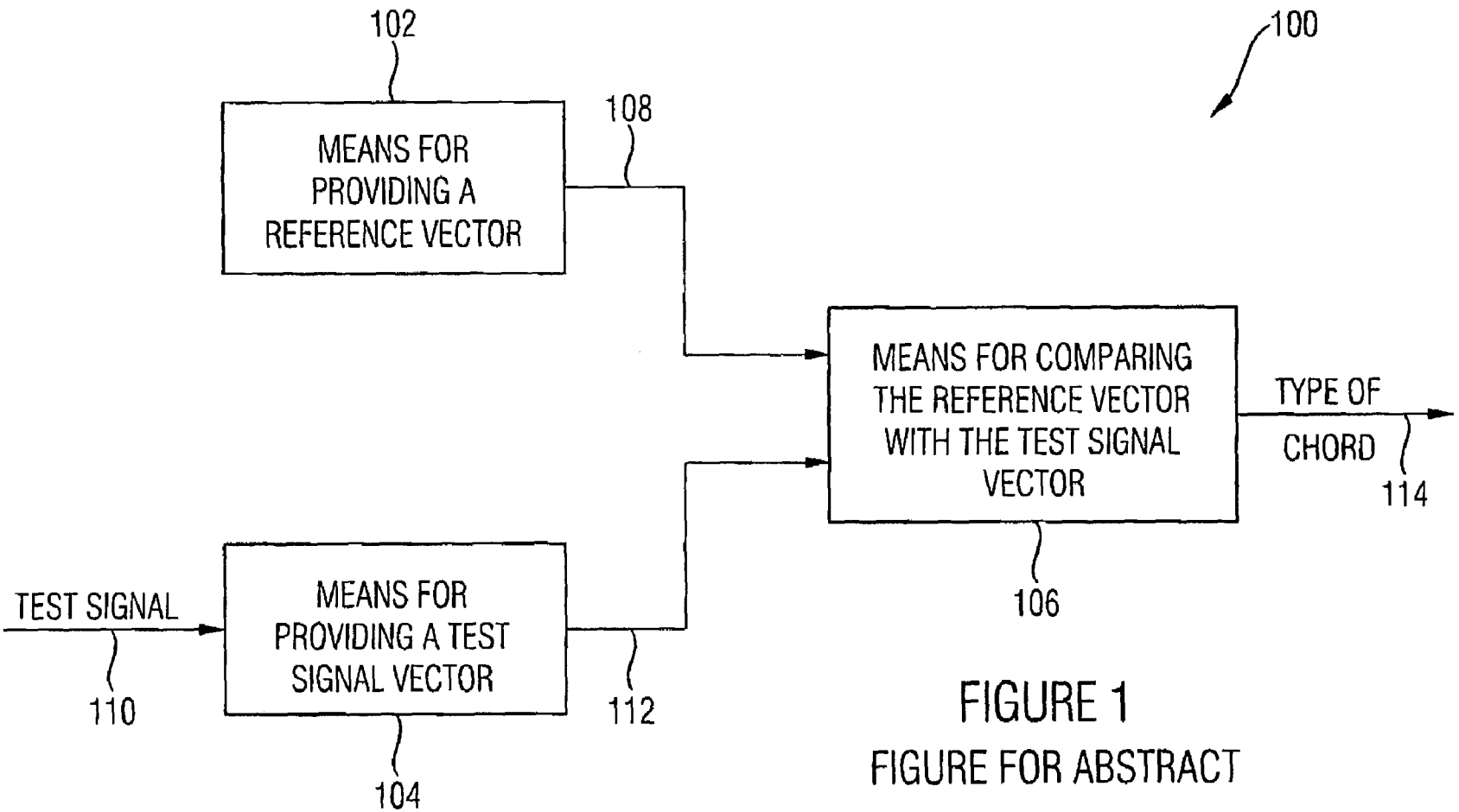
FIG. 1 shows a block diagram of an embodiment of the inventive apparatus for determining a type of chord.

In the subsequent description of the preferred embodiments of the present invention, identical or similar reference numerals will be used for those elements depicted in the various drawings which have similar actions; repeated descriptions of these elements being dispensed with.

FIG. 1 shows a block diagram of an embodiment of an inventive apparatus 100 for determining a type of chord underlying a test signal. Here, apparatus 100 includes a means 102 for providing a reference vector, a means 104 for providing a test signal vector, and a means 106 for comparing the reference vector with the test signal vector. Means 102 for providing a test vector may be configured, for example, to provide one reference vector, respectively, for major chords, minor chords or further classes of chords, and to supply them via a connection 108 to means 106 for comparing the reference vector with the test signal vector. In addition, means 104 for providing a test signal vector may be configured to determine the test signal vector from a test signal 110 and to supply said test signal vector, via connection 112, to means 106 for comparing the reference vector with the test signal vector. Here, the test signal 110, for example, may be present within a time domain representation which corresponds to an analog or digital representation of the piece of music to be examined. Means 104 for providing a test signal vector may then subject the test signal to a time-domain/frequency-domain transformation, whereby the frequencies occurring in the test signal can be determined, and whereby, for example, a piece of information or an amplitude in these frequencies occurring in the test signal can be written into individual elements of the test vector. Usually the frequencies occurring in the test signal are then associated with respective halftones in an octave. In means 106 for comparing the reference vector with the test signal vector, a type of chord is determined by means of a procedure which will be further described below, and said type of chord is output via an output 114.

The method of chord determination performed in means 106 for comparing is fundamentally based on a pattern recognition process. Tonal events (i.e. the occurrence of tones in the test signal) are compared with one (or several) reference vectors representing various types of chords and/or chord-type classes. These reference vectors may include a number of, e.g., 12 reference vector elements corresponding to the 12 different halftones in an octave of the Western scale of tones. In addition, those reference vector elements wherein respective tones or tones occur in the respective type of chord or the class of chord types may then be set to a value of 1, wherein the other reference vector elements may then be set to a value of 0. The tones occurring in a chord are significant for the type of chord and will be referred to as significance reference vector elements in the description which follows. For example, the reference vector for a major chord may contain the value of 1 in the first, fifth and eighth (significance) reference vector elements, or the reference vector for a minor chord may contain the value of 1 in the first, fourth and eighth reference vector elements, whereas the other reference vector elements have a value of 0 in the respective reference vectors.

As an alternative to major-key or minor-key reference vectors, other reference vectors may also be used, as are roughly reproduced in the tabular representation in FIG. 2. Here, various classes of chords, for example major or minor chords as well as other chord classes, such as sus4, diminished or augmented, are listed in the rows of the table represented in FIG. 2, wherein in the columns, a main chord HA for the respective class of chord and, subsequently, further side chords such as a chord of seventh (identified by the column designation 7), a further chord of seventh (identified by the column designation m7) and a further chord identified by the column designation 9 were indicated. The respective reference vectors may take on the following forms:

| | |
|---|---|
| major: | 100010010000 |
| minor: | 100100010000 |
| diminished: | 100100100000 |
| augmented: | 100010001000 |
| major 7: | 100010010010 |
| minor 7: | 100100010010 |
| major m7: | 100010010001 |
| minor m7: | 100100010001 |
| major sus4: | 100001010000 |
| major sus4 7: | 100001010010 |
| major sus4m7: | 100001010001 |
| major 9: | 101010010000 |
| minor 9: | 101100010000 |

In addition, for example a matrix with 12 rows may be prepared in means 104 for providing as is represented in FIG. 1, each row representing a halftone of the Western scale of tones, and adjacent columns of this matrix corresponding to segments of the piece of music to be examined which are successive in time. In the present example, the test signal may then be considered a time segment of the piece of music which is plotted in a column of the matrix. In the initialization of the matrix, the elements of the matrix are preferably set to zero. In order to determine the halftones in the respective matrix, for example an FFT (FFT=fast Fourier transformation) may be used as a time/frequency-domain transformation, as has been explained in more detail above. Hereby, from a time segment of the piece of music, the frequencies occurring in this time segment are determined, and in means 104 depicted in FIG. 1, for providing a test signal vector, a piece of information about the occurrence of a frequency is entered into those test signal vector elements which are allocated to the respective frequencies (halftones). For each time segment (i.e. for each time frame), the amplitudes or values derived from amplitudes may thus be entered into the columns of the previously mentioned matrix. Should one tone occur in more than one octave within the time segment or the time frame, the amplitudes or values, derived from amplitudes, of those tones having the same fundamental tone, however, may occur in several octaves, be summed up and be entered into the respective row and column. This results in that this tone obtains a higher weight for subsequent processing. Each column of this matrix is then successively compared with all reference vectors, which may be performed, for example, by calculating a scalar product from the reference vector and from the test signal vector formed from a column of the matrix. In addition, the reference vectors formed from the columns of the matrix are cyclically shifted such that all elements not having a value of 0 are arranged at the foremost position of the reference signal vectors once, and that in such an arrangement a comparative result is determined, for example by forming a scalar product. On this score, it is also to be noted that, in order to simplify the formation of the comparative result, one does not directly use the amplitudes of the frequencies occurring in the time segment or of the respective halftones, but that one may establish, by means of forming a threshold value, whether a frequency in the test signal (i.e. in the time segment to be examined) is present in a sufficient strength for further signal processing. This sufficient strength may be characterized, for example, by the amplitude value exceeding the threshold value, wherein in the event of the amplitude value exceeding the threshold value, the respective test signal vector element will obtain a value of 1, and wherein the test signal vector element of the respective halftone will obtain a value of 0 in the event that the amplitude does not exceed the threshold value of the respective tone. By means of such an association and/or threshold value formation, more unambiguous results may then be determined, wherein possibly erroneous amplitude values resulting from an imprecise time frequency domain transformation may be weakened in their effect.

By means of such cyclic shifting of the elements of the test signal vector, all possible chord inversions may thus be verified. The class of chord types identified by that reference vector which resulted in the highest scalar product in the comparison, for example, by the formation of the scalar product, will then be output as the class of the chord type. In addition, the respective fundamental tone of the chord type recognized is determined from the number of cyclic shifts performed which led to the highest scalar product.

To prevent such an apparatus for determining a type of chord from identifying incomplete chords, an additional criterion may be applied. The results of the scalar-product formation for reference vectors which contain the value of 1 in one component of the reference vector, and exhibit the value of 0 at the respective location of the input vector (test vector) are disregarded in determining the type of chord. In the event that only such reference vectors are available which, in connection with an input vector, lead to such a disregard of the results for the chord recognition, the algorithm suggested herein may be configured such that it outputs the individual notes within the respective time frame or time segment.

In the event that the input vector comprises more elements than the reference vector, the closest match between the input vector and the reference vector is selected. This may be effected, for example, in that in the input vector individual elements are taken out, whereby the input vector is reduced in length. This reduced input vector may then be compared with the respective reference vector(s), and/or the scalar product may be formed, and the result which provides the best comparison value or the highest scalar product may be output as the final result. In this case, a value which is dependent on the amplitudes of the respective notes becomes particularly relevant, since loud tones then obtain more importance in the calculation of the scalar product. As a last step, a text file may be generated which contains all identified chords and/or chord types in a chronological order.

In addition, harmonies whose time durations are too short for them to be taken into account may be removed from the list, since a safe assumption may be seen in that matching chords do not change within intervals of milliseconds.

One major advantage of the previously suggested algorithm thus is the fact that it exhibits an upward compatibility for determining further chord types, which is possible simply by adding new reference vectors to the chord matrix.

Figure 3:
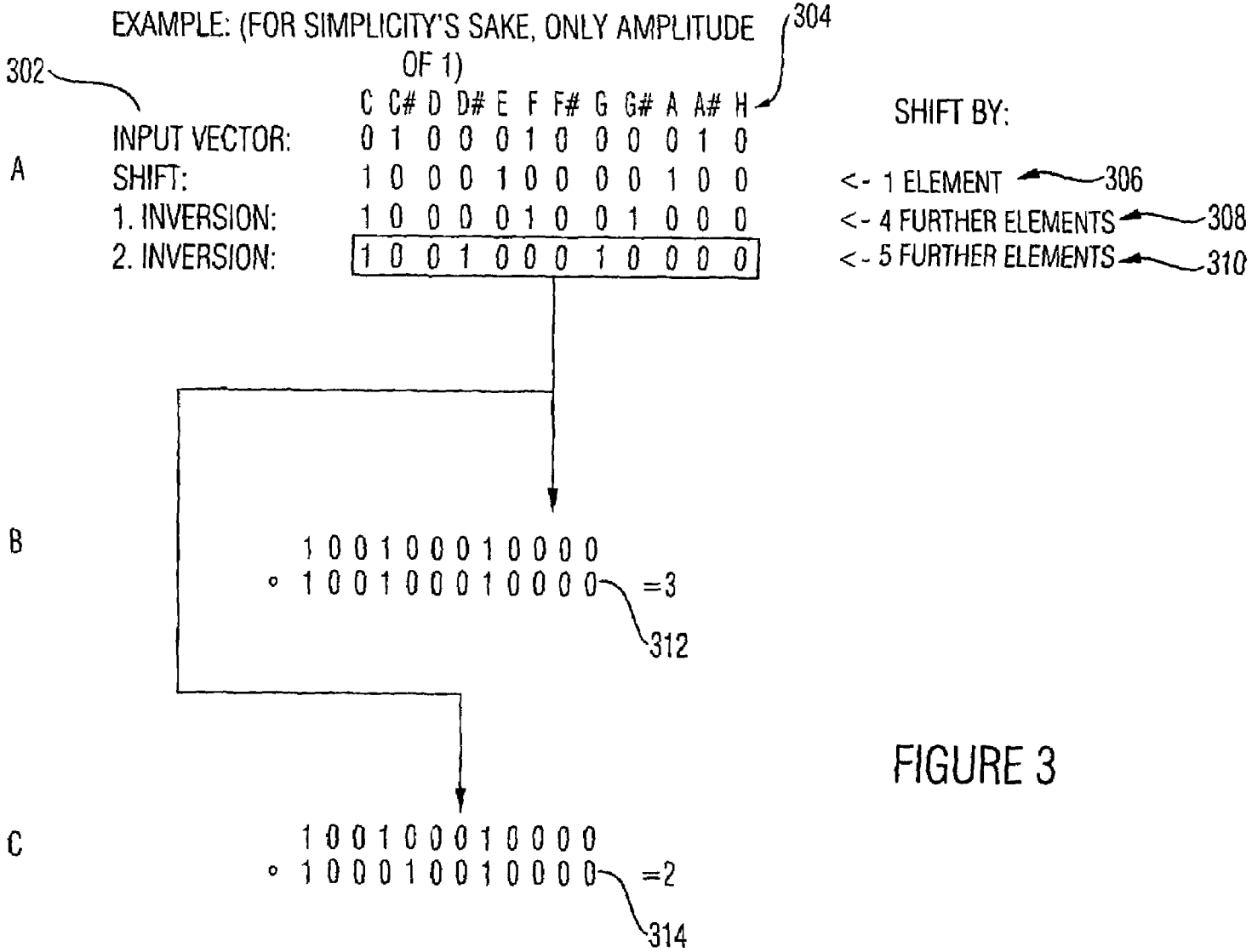
FIGS. 3A to 3C show a representation of an embodiment of the inventive method for determining a type of chord.
Figure 5:
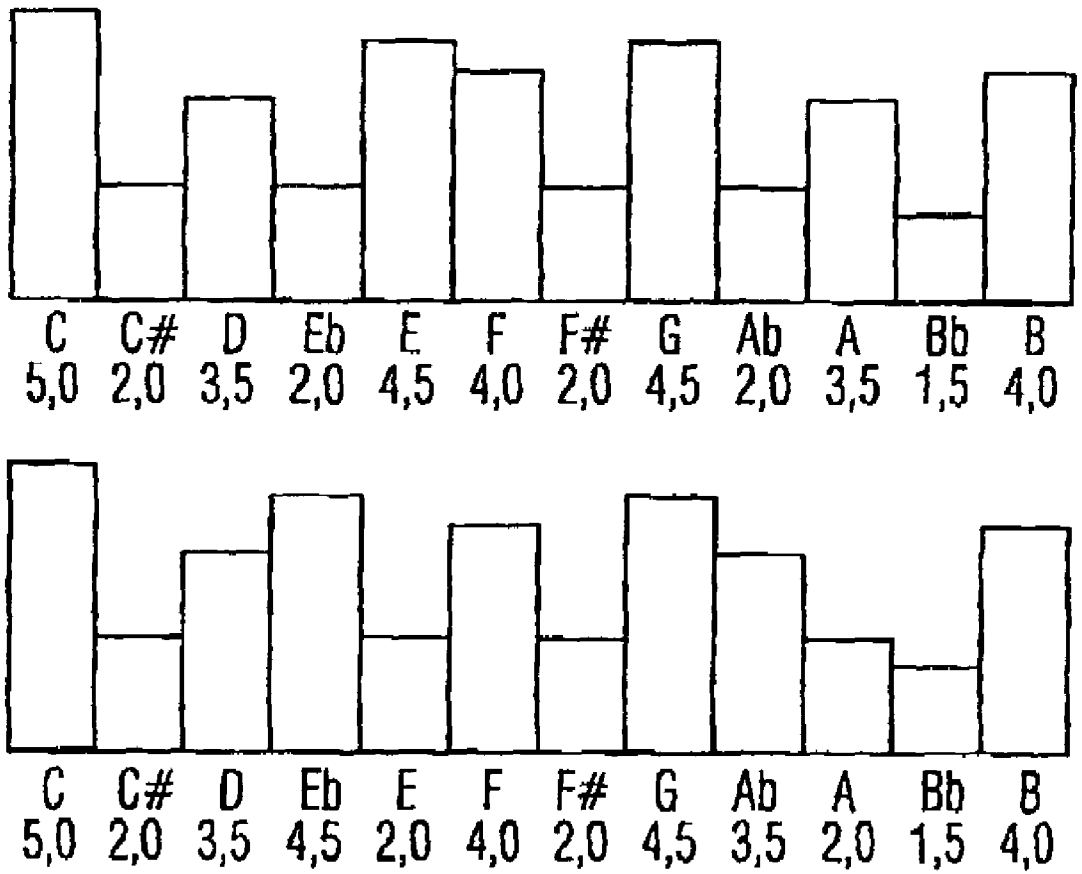
FIGURE 5 (PRIOR ART)
FIGS. 5A and 5B show a representation of histograms used as reference vectors in a conventional determination of the key.

FIG. 3 shows the approach in performing the inventive method in one embodiment. For this purpose, use is made, for example, of the matrix mentioned in the description of FIG. 1 which reproduces the tones and/or halftones of an octave in the rows, and the individual time segments or time frames of the piece of music to be examined in the column. FIG. 3A depicts a column of such a matrix now as an input vector 302 in the form of rows, wherein each element of this input vector corresponds to a halftone of the Western scale of tones, the halftones and/or halftone steps of which are reproduced in row 304. For simplicity's sake it shall be assumed that the amplitudes of the frequencies or halftones occurring in the input vector (i.e. the frequencies or halftones occurring in the time segment which corresponds to the input vector) have amplitudes of only 1 or 0. By analogy therewith, a normalization to a value of 1 may be effected when the amplitude of the respective tone exceeds a threshold value, or a normalization to the value of 0 may be effected when the amplitude of the respective tone falls below the threshold value. Intermediate values are thus eliminated by the above-described threshold-value decision. However, such an elimination is not absolutely necessary for the described method to function.

For investigating the chord types occurring in the individual time segments of the piece of music to be examined, the above-described matrix is passed through on a column-by-column basis, and thus the current column, respectively, is examined as an input vector 302, as is depicted in FIG. 3A. The chord recognition then is based on comparing this vector 302, in all possible inversions, with reference vectors representing the various types of chords. The reference vectors implemented so far here correspond to the reference vectors which have been explained in more detail with reference to FIG. 2. For example, the sequence of the values of 100100010000 has been used as the reference vector for the minor chords.

In the inventive approach, the input vector 302 is initially shifted, if required, such that the first element (i.e. that element which is at the foremost position of the reference vector) does not have the value of 0. Since in FIG. 3A the input vector has the values of 010001000010, a shifted input vector which has a value of 1 in the first vector element (i.e. at the foremost position) may be obtained by cyclic shifting of the input vector to the left by one element. Such a shift by one element is depicted in row 306 in FIG. 3A. For such an inversion, as has been performed in row 306, a comparison value may then be calculated in the form of a scalar product, as results in a scalar product value of 1 when using the reference vector for minor chords. A list of such scalar product values using the reference vector for minor chords and the respective shift values is depicted in more detail in FIG. 4. The shift value here indicates the number of shifts by which a shifted input vector has been cyclically shifted with regard to the original input vector 302.

For performing the first inversion, the input vector shifted in row 306 is then cyclically shifted to the left by 4 further elements, so that the value of 1 again occurs at a foremost, or first, position of the new shifted input vector. Such a shift by further 4 elements is depicted in FIG. 3A in row 308. A calculation of the scalar product for this shift value (i.e. the shift value 5=1 +4) results in the scalar product value of 1. By analogy therewith, for forming the second inversion, a cyclic shift to the left is again performed for such time until the value of 1 is again at the foremost, or first, position of the third shifted input vector. Such a third shifted input vector having the value of 1 at the foremost, or first position of the third shifted input vector may be performed by a further shift of 5 elements, as may be seen in FIG. 3A in row 310. By forming the scalar product for the third shifted input vector using the reference vector for minor chords, a scalar product value of 3 may thus be determined, as is depicted by the scalar product formation in FIG. 3B. In this scalar product formation, the reference vector for minor chords 312 is multiplied, on an element-by-element basis, by the third shifted input vector as results from FIG. 3A, row 310 and the products are subsequently added in an element-by-element manner, which results in the scalar product value of 3. If, on the other hand, a reference vector for major chords 314 is used, as is depicted in FIG. 3C, and if the scalar product is formed therefrom with the third shifted input vector, a value of two will result, which is thus lower than the scalar product when using the reference vector for minor chords. What may be inferred from this is that for the condition of maximizing the scalar product (i.e. the search for extreme comparative results), the respective type of chord of the original input vector 302 must be a minor chord, since the scalar product for the minor-key reference vector 312 is higher than the scalar product of the major-key reference vector 314, related to the third shifted input vector, respectively. In an alternative approach, it is also possible to determine, one scalar product between each individual inversion and each individual reference vector, and to eventually determine that reference vector the use of which resulted in the generation of the highest scalar product.

The fundamental tone of the chord type may then be determined by evaluating that shift value by which the input vector 302 was shifted to obtain the shifted input vector used to calculate, with the reference vector, the maximum scalar product. For the embodiment of input vector 302 which is selected in FIG. 3, the maximum scalar product (with the value of 3) may thus be determined in a cyclic shift to the left by 10 elements and using the reference vector for minor chords, the shift value of 10 leading to a fundamental tone of A#, which results in the chord type of A# minor. Such an association 400 of shift values to chord types is depicted in further detail in FIG. 4. Such an association 400 may also be implemented as a look-up table, for example in a memory in means 106 for comparing the reference vector with the test signal vector, so as to obtain a marked acceleration in determining the chord type when the shift value number is known.

As an alternative to the above-mentioned possibility of summing amplitudes of tones occurring in various octaves, a deletion of overtones may also occur. Each music note—except for pure synthetic sinus signals—consists of more than one frequency component. These additional components are known as overtones or harmonics and appear in the spectral representation at multiples of their fundamental frequencies. The difficulty with obtaining a reliable harmonics analysis from a frequency-domain representation of a music signal predominantly consists in identifying these overtones and using only the fundamental tone (in one octave), if possible, for finding the chord. Here, two further assumptions have been made for further chord recognition:

1. An overtone can occur only during that time duration during which the fundamental tone is also present.
2. The amplitude levels of the overtones do not exceed the level of the fundamental tone.

Particularly the second assumption has proven to be problematic, since in polyphonic music it is quite common for two fundamental tones to occur at the same time, the higher fundamental tone having a lower level than the lower fundamental tone, and the higher fundamental tone being an overtone of the lower fundamental tone. According to the above assumption, the higher fundamental tone would then have to be deleted. In chord recognition this may lead to the fact that when determining a type of chord, those tones which lie outside of an octave contemplated are not used for determining the chord type.

Depending on the circumstances, the inventive method for determining a chord type which underlies a test signal may be implemented in hardware or in software. The implementation may be effected on a digital storage medium, in particular a disc or CD with electronically readable control signals which can cooperate with a programmable computer system such that the respective method is performed. Generally, the invention thus also consists in a computer program product having a program code, stored on a machine-readable carrier, for performing the inventive method, when the computer program product runs on a computer. In other words, the invention may thus be realized as a computer program having a program code for performing the method, when the computer program runs on a computer.

In summary, it may thus be stated that a matrix may be formed, from a piece of music to be examined, which in the rows contains the halftones of an octave, and in the columns contains the time segments, i.e. the time frames of the piece of music to be examined, and that such values which correspond, with respect to their amplitude values, to those amplitudes which occur at the respective time segments and halftones may be entered into the respective matrix elements. To perform the chord recognition, the matrix may now be passed through on a column-by-column basis, and the respectively current column may be examined as a vector. The chord recognition is then based on comparing this vector, in all possible inversions, with reference vectors representing the various types of chords.

Initially, the input vector, i.e. a column of the matrix, may be shifted, if necessary, such that the first element has no value of 0. Then, the scalar products are formed with all reference vectors. Subsequently, this is also calculated for all inversions of the input vector. In a specific form, no evaluation will then need to be performed for all comparisons wherein the reference vector exhibits ones in elements in which the input vector has zeros. If this is true for all comparisons, the individual tones, for example, will be output from the algorithm introduced here. Otherwise, that reference vector which has the highest scalar product will "win". The fundamental tone results from the number of elements by which the input vector has been shifted for the comparison with the highest result. In FIGS. 3 and 4, the minor-key reference vector is that which has the highest scalar product, specifically for the comparison with the second inversion as compared to, for example, the major-key reference vector. Therefore, a minor chord is assumed. The fundamental tone results from the fact that the vector for the highest scalar product comes about by shifting a total of 10 elements. A# is situated 10 halftones above the C, i.e. a chord type of A# minor is assumed. Preferably, only such chords are output which are kept for a minimum duration of, e.g., 10 time frames. The chords found may then be entered, in a chronological order, into a text file with their respective durations, and this text file may be output.

While this invention has been described in terms of several preferred embodiments, there are alterations, permutations, and equivalents which fall within the scope of this invention.

It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for determining a type of chord underlying a test signal, the type of chord being defined by an occurrence of predetermined frequencies in a frequency range of the test signal, and the predefined frequencies in the frequency range of the test signal corresponding to tones in a predetermined spectral margin, wherein a first type of chord has at least one predefined significant tone in the spectral margin and wherein a second type of chord has a second predefined significant tone in the spectral margin, wherein the first significant tone differs from the second significant tone, and wherein the apparatus for determining comprises:

a provider for providing a reference vector for the type of chord from a plurality of different reference vectors, the reference vector comprising a plurality of reference vector elements associated with one tone, respectively, in the spectral margin, and wherein at least one significant reference vector element is provided for each reference vector for a significant tone of an associated type of chord;

a provider for providing a test signal vector from the test signal, wherein the test signal vector comprises a plurality of test signal vector elements associated with one tone, respectively, in the spectral margin, wherein a test signal vector element is dependent on whether the tone associated with the test signal vector element occurs in the test signal, wherein the provider for providing a test signal vector is configured to allocate a value of one to a test signal vector element if the tone corresponding to the test signal vector element has an amplitude value which exceeds a predetermined threshold value, and wherein the provider for providing a test signal vector is configured to allocate a value of zero to the test signal vector element if the tone which corresponds to the test signal vector element has an amplitude value falling below the predetermined threshold value; and a comparator for comparing the reference vector with the test signal vector, the comparator being configured to compare the reference vector with the test signal vector or with versions of the test signal vector which are cyclically shifted by various shift values in the frequency range, in order to obtain various comparative results allocated to the test signal vector or shift values in order to determine the type of chord on the basis of an extreme comparative result and of the shift value associated with same.

2. The apparatus as claimed in claim 1, wherein the predetermined spectral margin of an octave, and the tones in the predetermined spectral margin correspond to halftones in the octave, the provider for providing the reference vector being configured to provide a reference vector having twelve reference vector elements, and the provider for providing the test signal vector being configured to provide a test signal vector having 12 test signal vector elements.

3. The apparatus as claimed in claim 1, wherein the provider for providing a test signal vector is configured to transform a test signal, which is present in a time domain representation, to a frequency domain representation.

4. The apparatus as claimed in claim 1, wherein the comparator is configured to perform a scalar product formation between the reference vector and the test signal vector or versions of the test signal vector which are cyclically shifted by various shift values, in order to obtain the comparative result.

5. The apparatus as claimed in claim 1, wherein the comparator is configured to cyclically shift the test signal vector elements of the test signal vector by a shift value such that a test signal vector element having a value of one is arranged at a foremost position in the shifted test signal vector, the comparator further being configured to determine a comparative result of the reference vector with the shifted test signal vector.

6. The apparatus as claimed in claim 5, wherein the comparator is further configured to cyclically shift the shifted test signal vector by a further shift value such that a test signal vector element having a value of one is again arranged at a foremost position in the new shifted test signal vector, the comparator further being configured to determine a comparative result of the reference vector with the new shifted test signal vector.

7. The apparatus as claimed in claim 1, wherein the comparator is configured to determine no comparative result between the reference vector and the test signal vector or a version of the test signal vector which is cyclically shifted by a shift value if that test signal vector element which is arranged at a position in the test signal vector which corresponds to a position of a significance reference vector element in the reference vector has a value of zero.

8. The apparatus as claimed in claim 1, wherein the comparator is configured to determine no comparative result between the reference vector and the test signal vector if a time duration of the tones in the predetermined spectral margin falls below a predetermined minimum-duration threshold value.

9. The apparatus as claimed in claim 1, wherein the provider for providing a reference vector is configured to provide a first reference vector for a first class of chord types, and a second reference vector for a second class of chord types.

10. The apparatus as claimed in claim 9, wherein the chord types of the first class are major chords, and the chord types of the second class are minor chords, the provider for providing a reference vector being configured to provide a sequence of values of the reference vector elements of 10001001000 as the first reference vector, and a sequence of values of the reference vector elements of 1000100010000 as the second reference vector.

11. The apparatus as claimed in claim 1, wherein the provider for providing the test signal vector is configured to separate a received signal into a first test signal and a second test signal which succeeds the first test signal in time, the provider for providing a test signal vector further being configured to provide a first test signal vector on the basis of the first test signal, and a second test signal vector on the basis of the second test signal, the comparator further being configured to determine a first type of chord on the basis of the first test signal vector and a second type of chord on the basis of the second test signal vector.

12. The apparatus as claimed in claim 1, wherein the test signal has a signal portion in a frequency segment which lies outside the predetermined spectral margin, the provider for providing a test signal vector being configured to change a test signal vector element as a function of the signal portion.

13. The apparatus as claimed in claim 1, wherein the comparator includes a memory in which an association of a reference vector and of a shift value with a type of chord may be stored, the comparator further being configured to link a comparative result with the association of the reference vector and of a shift value to the type of chord.

14. A method for determining a type of chord underlying a test signal, the type of chord being defined by an occurrence of predetermined frequencies in a frequency range of the test signal, and the predefined frequencies in the frequency range of the test signal corresponding to tones in a predetermined spectral margin, wherein a first type of chord has at least one predefined significant tone in the spectral margin and wherein a second type of chord has a second predefined significant tone in the spectral margin, wherein the first significant tone differs from the second significant tone, and wherein the method for determining comprises:

providing a reference vector for the type of chord from a plurality of different reference vectors, the reference vector comprising a plurality of reference vector elements associated with one tone, respectively, in the spectral margin, and wherein at least one significant reference vector element is provided for each reference vector for a significant tone of an associated type of chord;

providing a test signal vector from the test signal, wherein the test signal vector comprises a plurality of test signal vector elements associated with one tone, respectively, in the spectral margin, wherein a test signal vector element is dependent on whether the tone associated with the test signal vector element occurs in the test signal, wherein the step of providing a test signal vector includes allocating a value of one to a test signal vector element if the tone corresponding to the test signal vector element has an amplitude value which exceeds a predetermined threshold value, and wherein the step of providing a test signal vector includes allocating a value of zero to a test signal vector element if the tone which corresponds to the test signal vector element has an amplitude value falling below the predetermined threshold value; and comparing the reference vector with the test signal vector, the comparator being configured to compare the reference vector with the test signal vector or with versions of the test signal vector which are cyclically shifted by various shift values, in order to obtain various comparative results allocated to the test signal vector or shift values in order to determine the type of chord on the basis of an extreme comparative result and of the shift value associated with same.

15. A digital storage medium having a computer readable program code embodied therein for performing the method for determining a type of chord underlying a test signal, the type of chord being defined by an occurrence of predetermined frequencies in a frequency range of the test signal, and the predefined frequencies in the frequency range of the test signal corresponding to tones in a predetermined spectral margin, wherein a first type of chord has at least one predefined significant tone in the spectral margin and wherein a second type of chord has a second predefined significant tone in the spectral margin, wherein the first significant tone differs from the second significant tone, and wherein the method for determining comprises:

providing a reference vector for the type of chord from a plurality of different reference vectors, the reference vector comprising a plurality of reference vector elements associated with one tone, respectively, in the spectral margin, and wherein at least one significant reference vector element is provided for each reference vector for a significant tone of an associated type of chord;

providing a test signal vector from the test signal, wherein the test signal vector comprises a plurality of test signal vector elements associated with one tone, respectively, in the spectral margin, wherein a test signal vector element is dependent on whether the tone associated with the test signal vector element occurs in the test signal, wherein the step of providing a test signal vector includes allocating a value of one to a test signal vector element if the tone corresponding to the test signal vector element has an amplitude value which exceeds a predetermined threshold value, and wherein the step of providing a test signal vector includes allocating a value of zero to a test signal vector element if the tone which corresponds to the test signal vector element has an amplitude value falling below the predetermined threshold value; and comparing the reference vector with the test signal vector, the comparator being configured to compare the reference vector with the test signal vector or with versions of the test signal vector which are cyclically shifted by various shift values, in order to obtain various comparative results allocated to the test signal vector or shift values in order to determine the type of chord on the basis of an extreme comparative result and of the shift value associated with same, when the program runs on a computer.

* * * * *